US012448763B2

(12) United States Patent
Torak et al.

(10) Patent No.: US 12,448,763 B2
(45) Date of Patent: Oct. 21, 2025

(54) TOWEL BAR SINK

(71) Applicant: Kraus USA Plumbing LLC, Port Washington, NY (US)

(72) Inventors: Serhiy Torak, Brooklyn, NY (US); Todd Alexander, Hollis, NH (US)

(73) Assignee: Kraus USA Plumbing LLC, Port Washington, NY (US)

( * ) Notice: Subject to any disclaimer, the term of this patent is extended or adjusted under 35 U.S.C. 154(b) by 105 days.

(21) Appl. No.: 18/412,073

(22) Filed: Jan. 12, 2024

(65) Prior Publication Data

US 2024/0247471 A1 Jul. 25, 2024

Related U.S. Application Data

(60) Provisional application No. 63/441,036, filed on Jan. 25, 2023.

(51) Int. Cl.
*E03C 1/182* (2006.01)
*A47K 10/08* (2006.01)

(52) U.S. Cl.
CPC ..... *E03C 1/182* (2013.01); *A47K 10/08* (2013.01)

(58) Field of Classification Search
CPC ..... A47K 10/08; E03C 1/182
USPC ..... 4/638, 637
See application file for complete search history.

(56) References Cited

U.S. PATENT DOCUMENTS

| | | | | |
|---|---|---|---|---|
| 5,217,123 | A * | 6/1993 | Riley | A47K 10/08 248/206.3 |
| 9,157,219 | B2 | 10/2015 | Gibson | |
| 9,708,802 | B2 | 7/2017 | Gibson | |
| 9,783,967 | B2 | 10/2017 | Jain et al. | |
| 10,221,547 | B2 | 3/2019 | Gibson | |
| 10,226,154 | B2 | 3/2019 | Richards | |
| 10,870,973 | B2 | 12/2020 | Gibson | |
| 11,384,518 | B2 | 7/2022 | Gibson | |
| 11,414,849 | B2 | 8/2022 | Sonoda | |
| 2009/0314730 | A1* | 12/2009 | Mansikkamaa | A47L 13/51 211/113 |
| 2012/0266377 | A1 | 10/2012 | Eilmus | |
| 2020/0015653 | A1 | 1/2020 | Mei | |
| 2022/0178122 | A1 | 6/2022 | Grybush et al. | |
| 2022/0307246 | A1 | 9/2022 | Gibson | |

FOREIGN PATENT DOCUMENTS

| | | | |
|---|---|---|---|
| CN | 203000870 | U | 6/2013 |
| CN | 112144615 | A | 12/2020 |
| DE | 102009035657 | A1 | 2/2011 |
| KR | 200311287 | Y1 | 4/2003 |
| KR | 102186047 | B1 | 12/2020 |

* cited by examiner

*Primary Examiner* — Lauren A Crane
(74) *Attorney, Agent, or Firm* — Bose McKinney & Evans LLP

(57) ABSTRACT

A towel bar sink having a sink basin including openings that can accommodate a removable accessory bar and a light module.

17 Claims, 11 Drawing Sheets

TOWEL BAR SINK

CROSS-REFERENCE TO RELATED APPLICATION

The present application claims priority to U.S. Provisional Patent Application Ser. No. 63/441,036, filed Jan. 25, 2023, the disclosure of which is expressly incorporated herein by reference.

BACKGROUND AND SUMMARY OF THE DISCLOSURE

The present invention relates generally to a sink and, more particularly to a towel bar sink including a basin having removable bars for supporting accessories and interchangeable with light assemblies.

The present invention relates to a sink supporting removable accessory bars. The bars may support accessories such as a storage caddy, towels, cutting boards, etc. without the need for additional accessory connectors or supports. As such, the present invention provides for an "all-in-one" utility sink without the need for extra, bulky accessories. A user can remove one or more accessory bars from holders supported by the sink and replace the accessory bars holders with light assemblies. The light assemblies may be motion sensor activated and/or act as a nightlight. Additionally, the sink may include a workstation for additional accessories the user desires to add.

According to an illustrative embodiment of the present disclosure, a towel bar sink includes a sink basin having a front wall, a first sidewall, a second sidewall, and a rear wall extending upwardly from a bottom. The first sidewall includes a first opening, and the second sidewall includes a second opening. The first opening on the first sidewall and the second opening on the second sidewall are laterally opposed to each other. An accessory bar includes a first end and a second end, wherein the first end of the accessory bar is supported by the first opening on the first sidewall, and the second end of the accessory bar is supported by the second opening on the second sidewall. A first holder includes a first receiver and is configured to secure the first end of the accessory bar to the first sidewall of the sink basin. A second holder includes a second receiver and is configured to secure the second end of the accessory bar to the second sidewall of the sink basin. A light module includes a light, a controller operably coupled to the light, and a cover supported proximate the light. The light module is configured to fit into the first holder or the second holder when the accessory bar is removed from the respective first holder or second holder.

According to another illustrative embodiment of the present disclosure, a towel bar sink includes a sink basin having a first sidewall and a second sidewall in laterally spaced relation to the first sidewall. A first holder is supported by the first sidewall, and a second holder is supported by the second sidewall. The first holder and the second holder are configured to alternatively receive opposing ends of an accessory bar, and first and second light modules.

According to a further illustrative embodiment of the present disclosure, a towel bar sink kit includes a sink basin having a first sidewall and a second sidewall in laterally spaced relation to the first sidewall. A first holder is supported by the first sidewall, and a second holder is supported by the second sidewall. An accessory bar includes a first end and a second end. The first end of the accessory bar is configured to be supported by the first holder, and the second end of the accessory bar is configured to be supported by the second holder. A first light module includes a light, a controller operably coupled to the light, and a cover supported proximate the light. A second light module includes a light, a controller operably coupled to the light, and a cover supported proximate the light. The first light module is configured to fit into the first holder, and the second light module is configured to fit into the second holder.

Additional features and advantages of the present invention will become apparent to those skilled in the art upon consideration of the following detailed description of the illustrative embodiment exemplifying the best mode of carrying out the invention as presently perceived.

DETAILED DESCRIPTION OF THE DRAWINGS

Figure 1:
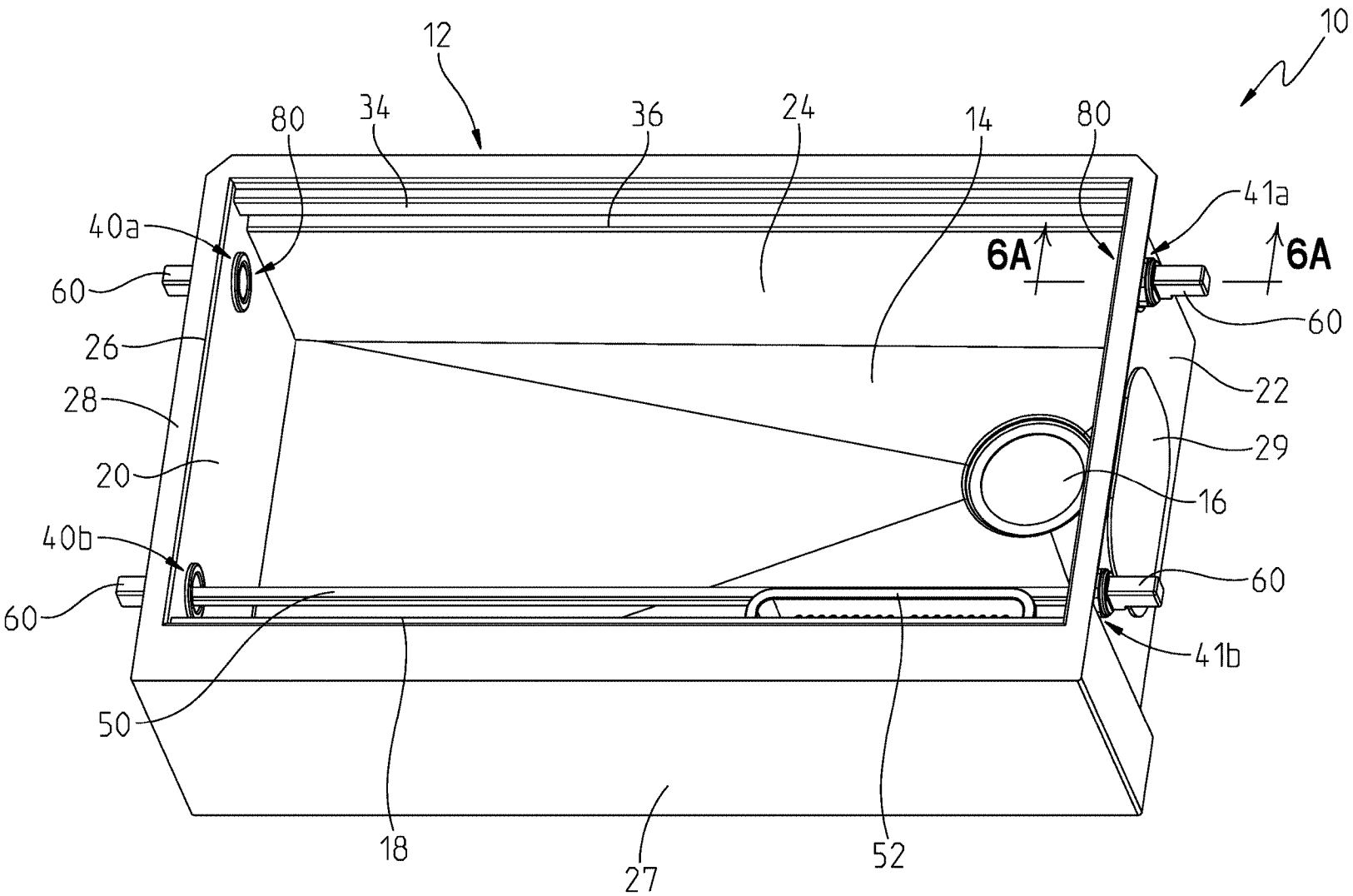
FIG. 1 is a front perspective view of an illustrative towel bar sink of the present disclosure.

For the purposes of promoting and understanding the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 2A:
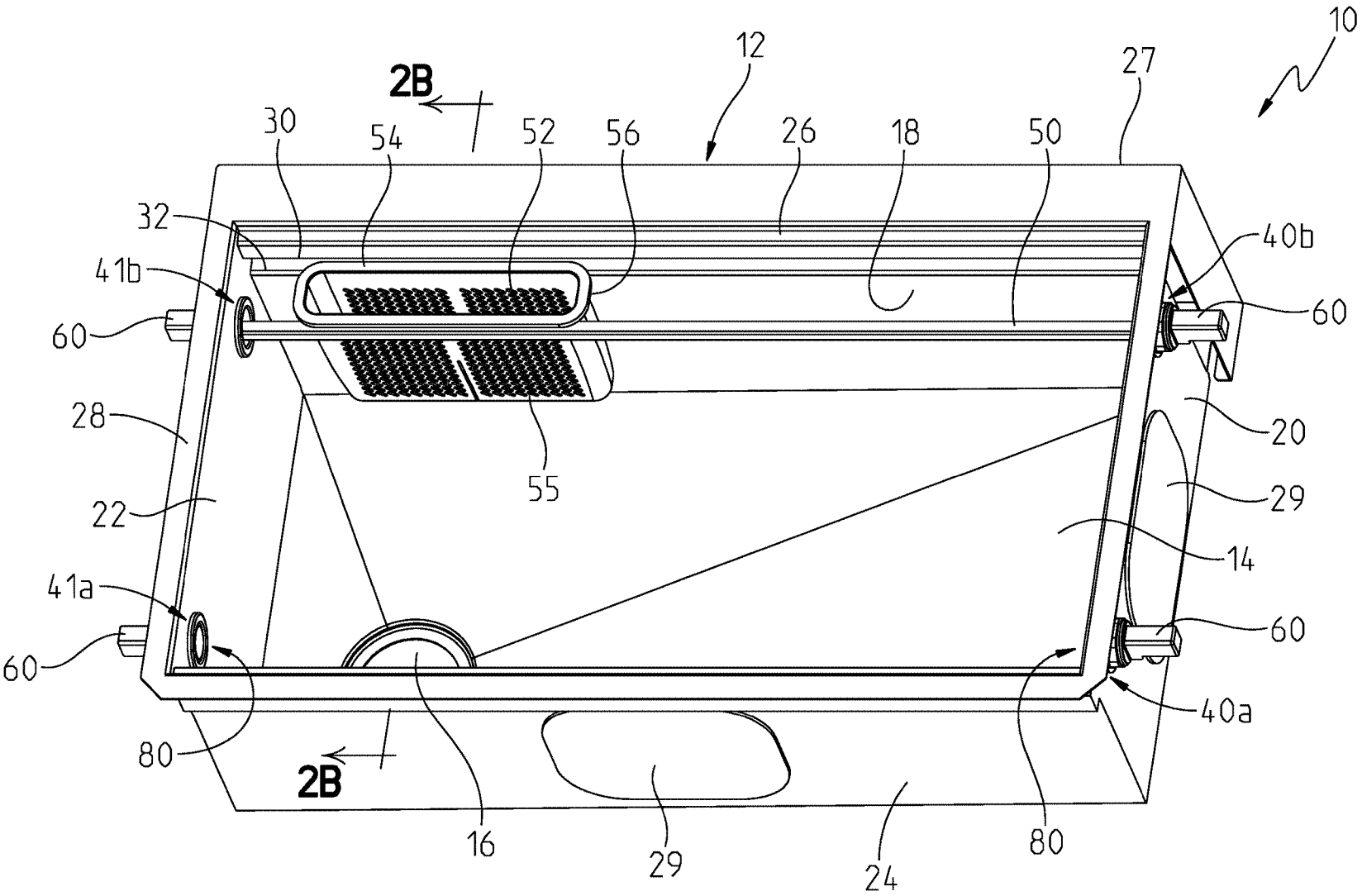
FIG. 2A is a rear perspective view of the towel bar sink of FIG. 1.
Figure 2B:
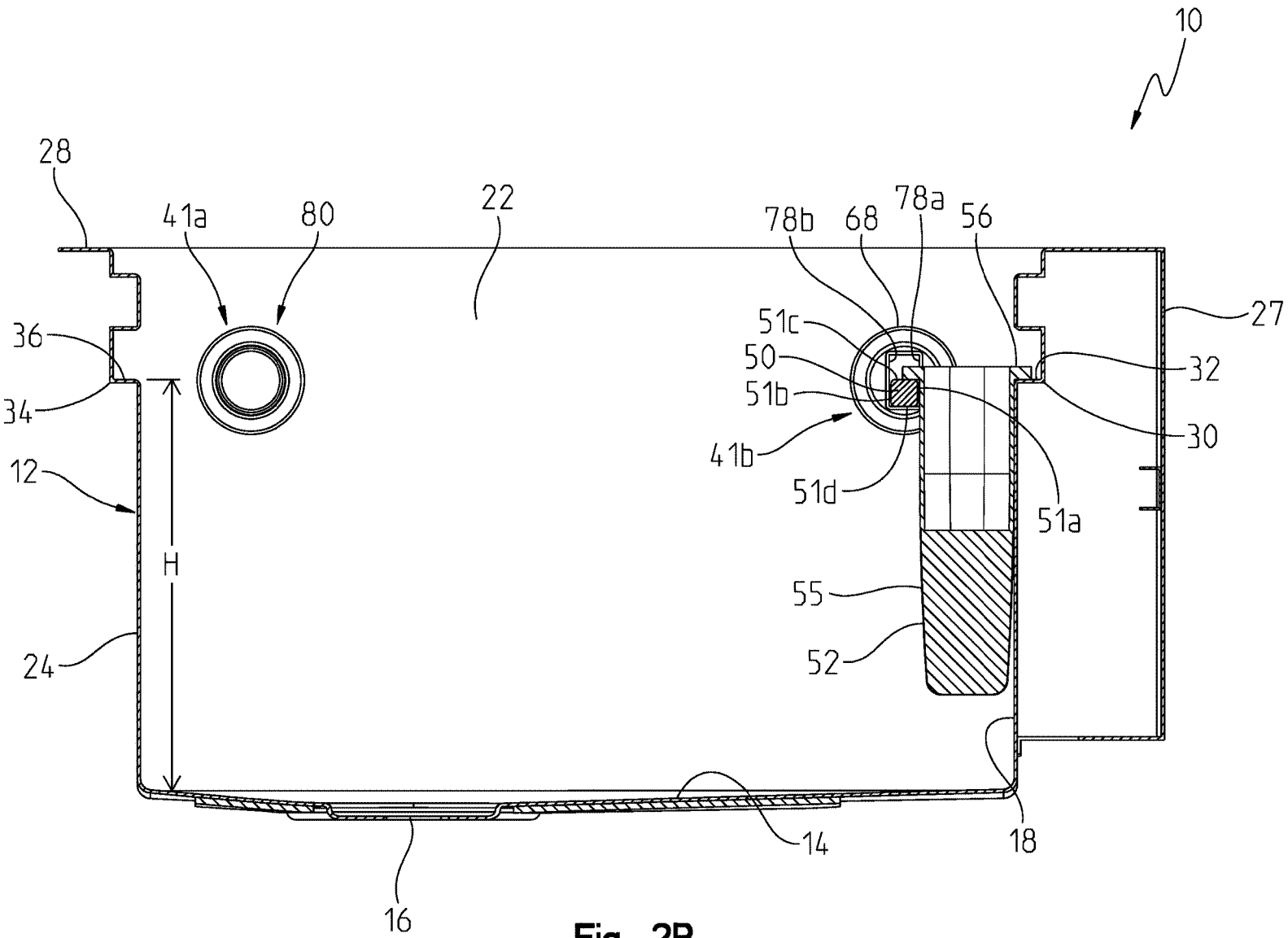
FIG. 2B is a cross-sectional view taken along line 2B-2B of FIG. 2A.
Figure 3:
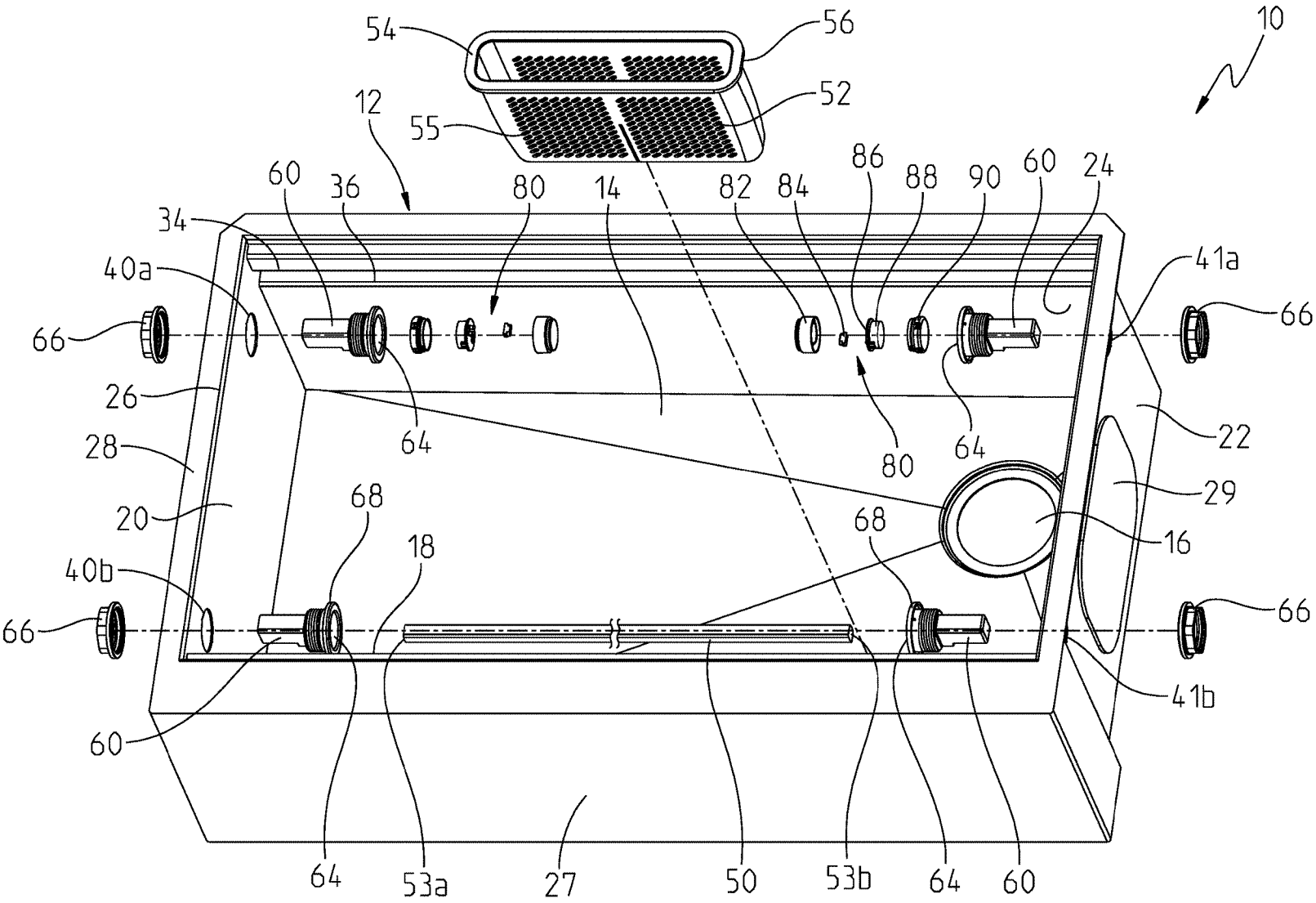
FIG. 3 is a partially exploded, front perspective view of the towel bar sink of FIG. 1.
Figure 4:
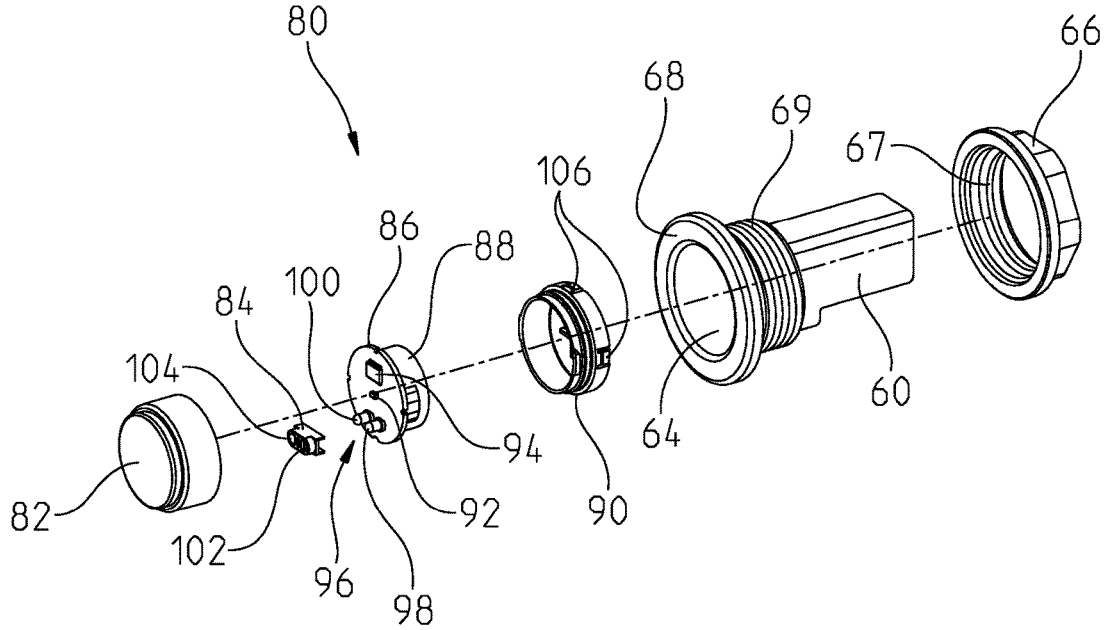
FIG. 4 is a front exploded view of the light module and the holder of the illustrative towel bar sink of FIG. 1.
Figure 5:
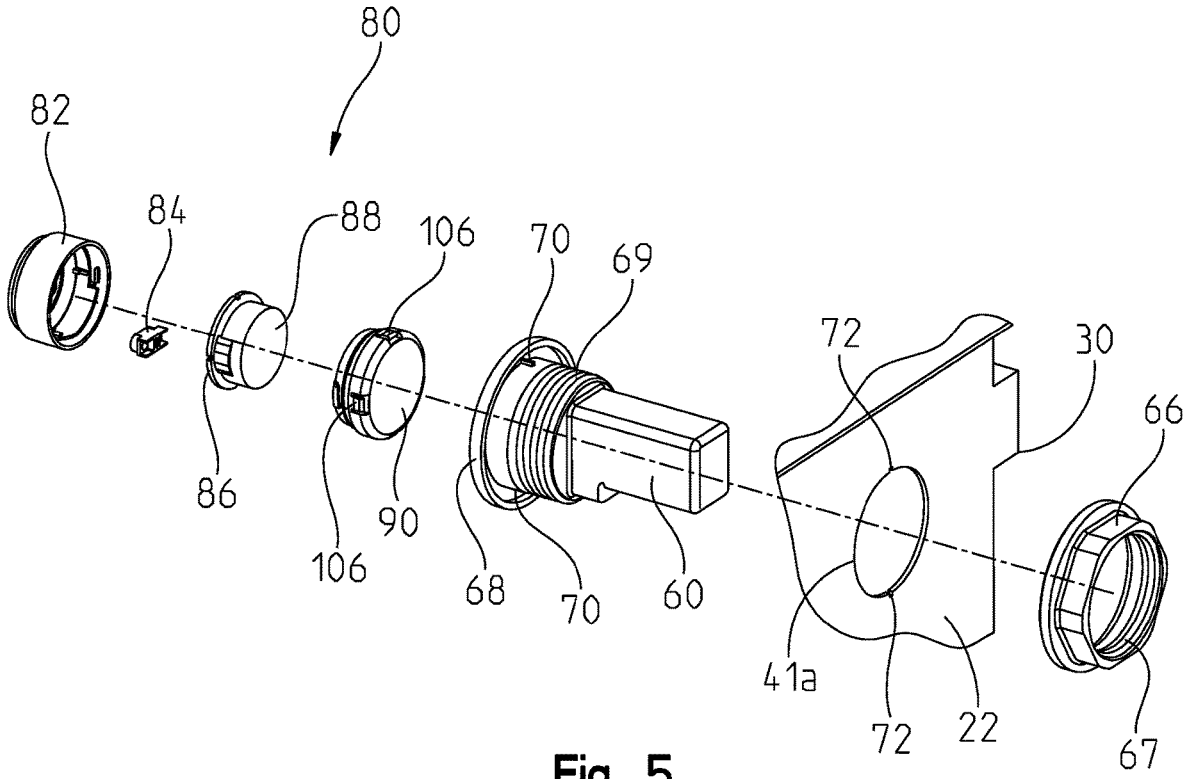
FIG. 5 is a rear exploded view of the light module and the holder of FIG. 4, showing an opening of the sink basin for receiving the holder.

Referring initially to FIGS. 1-3, an illustrative embodiment towel bar sink 10 is shown as including a sink basin 12. The sink basin 12 may be formed of a metal, such as stainless steel, and includes a bottom 14 which may be configured to direct water toward a drain 16. The sink basin 12 also includes a front wall 18, first and second side walls 20 and 22, and a rear wall 24 which extend upwardly from the bottom 14 to an upper rim 26. An apron 27 may extend in spaced relation to, and forward of, the front wall 18.

A flange 28 illustratively extends outwardly from the upper rim 26 around the perimeter of sink basin 12. Illustratively, the front wall 18 and the rear wall 24 are longitudinally opposed from each other, and the first side wall 20 and the second side wall 22 are laterally opposed from each other. Sound dampening pads 29 may be supported external to the walls 18, 20, 22 and 24. The pads 29 are illustratively formed of an elastomer and are configured to reduce sound from the metal sink basin 12.

Illustratively, the front wall 18 includes an outwardly extending step 30 with a top surface 32. In one illustrative embodiment, the top surface 32 is flat and parallel to the flange 28. In one embodiment, the top surface 32 may slope downwardly toward the bottom 14 of the sink basin 12. Illustratively, the rear wall 24 includes an outwardly extending step 34 with a top surface 36. In one illustrative embodiment, the top surface 36 is flat and parallel to the flange 28. In one illustrative embodiment, the top surface 36 may slope downward toward the bottom 14 of the sink basin 12.

Illustratively, the first side wall 20 includes a plurality of openings 40*a*, 40*b*, and the second side wall 22 includes a plurality of openings 41*a*, 41*b*. Openings 40*a* and 41*a* are laterally opposed and coaxially aligned, while openings 40*b* and 41*b* are laterally opposed and coaxially aligned. Illustratively, openings 40*a*, 40*b*, 41*a*, 41*b* are all centered at a height H, measured from the bottom 14 of the sink basin 12 (FIG. 2B). While two openings 40*a*, 40*b* and 41*a*, 41*b* are shown in each side wall 20 and 22 of the illustrative sink basin 12, it should be appreciated that the number, spacing and location of the openings 40*a*, 40*b* and 41*a*, 41*b* may vary.

The illustrative towel bar sink 10 also includes an accessory bar 50 that can be inserted into the sink basin 12. The accessory bar 50 may be formed of a metal, such as stainless steel, and includes a square cross-section including flat walls 51*a*, 51*b*, 51*c*, 51*d* extending between opposing first and second ends 53*a* and 53*b* (FIG. 3). The ends 53*a* and 53*b* of the accessory bar 50 can be inserted through openings 40*b* and 41*b* to be positioned near the front wall 18 of the sink basin 12 (FIGS. 1-2B), or through openings 40*a* and 41*a* to be positioned near the rear wall 24 of the sink basin 12. In certain illustrative embodiments, a first accessory bar 50 may be inserted through openings 40*b* and 41*b*, and a second accessory bar 50 may be inserted through openings 40*a* and 41*a*. Again, the number, the spacing and the location of accessory bars 50 may vary.

When inserted into the sink basin 12, the accessory bar 50 can be used to hold an accessory 52. Illustratively, the accessory 52 is shown as a storage caddy. However, the accessory 52 may be other accessories such as towels, cutting boards, etc. Illustratively, the storage caddy 52 may be formed of a polymer and includes a top flange 54 supporting a basket 55. To support the storage caddy 52 when inserted into the sink basin 12, the bottom surface 56 of the top flange 54 rests on the top surface 32, 36 of the sink basin step 30, 34 (dependent on where the accessory bar 50 is positioned (e.g., adjacent the front wall 18 or the rear wall 24)) and the upper surface 51*c* of the accessory bar 50.

Figure 6A:
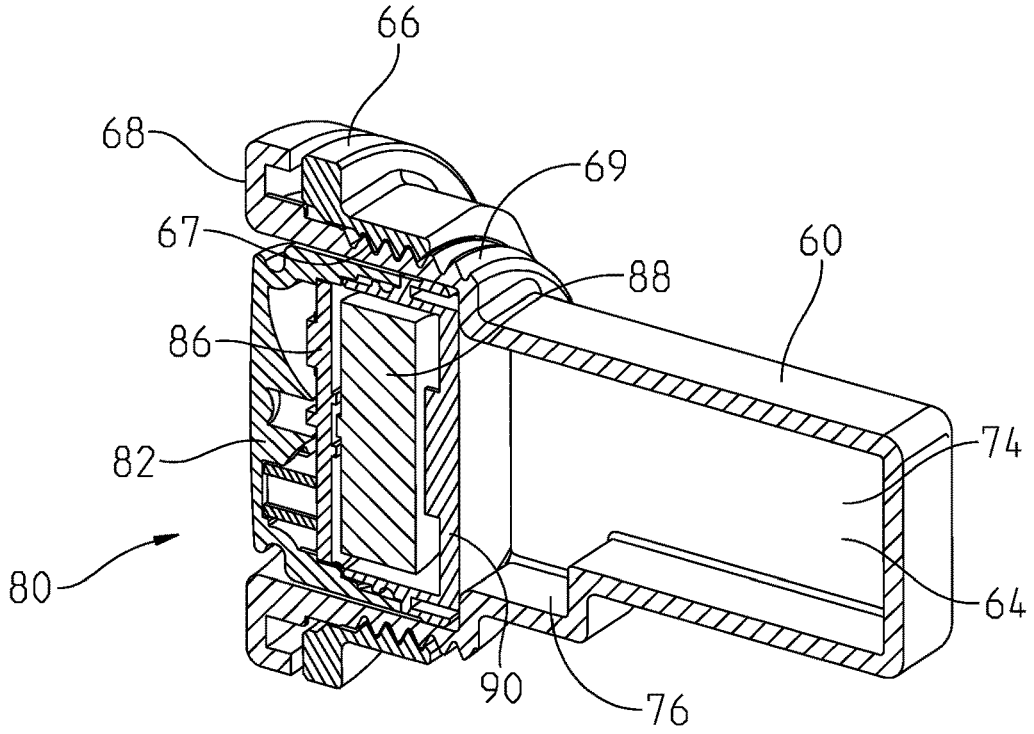
FIG. 6A is a perspective view, in cross-section taken along line 6A-6A, of the light module and the holder of FIG. 1.
Figure 6B:
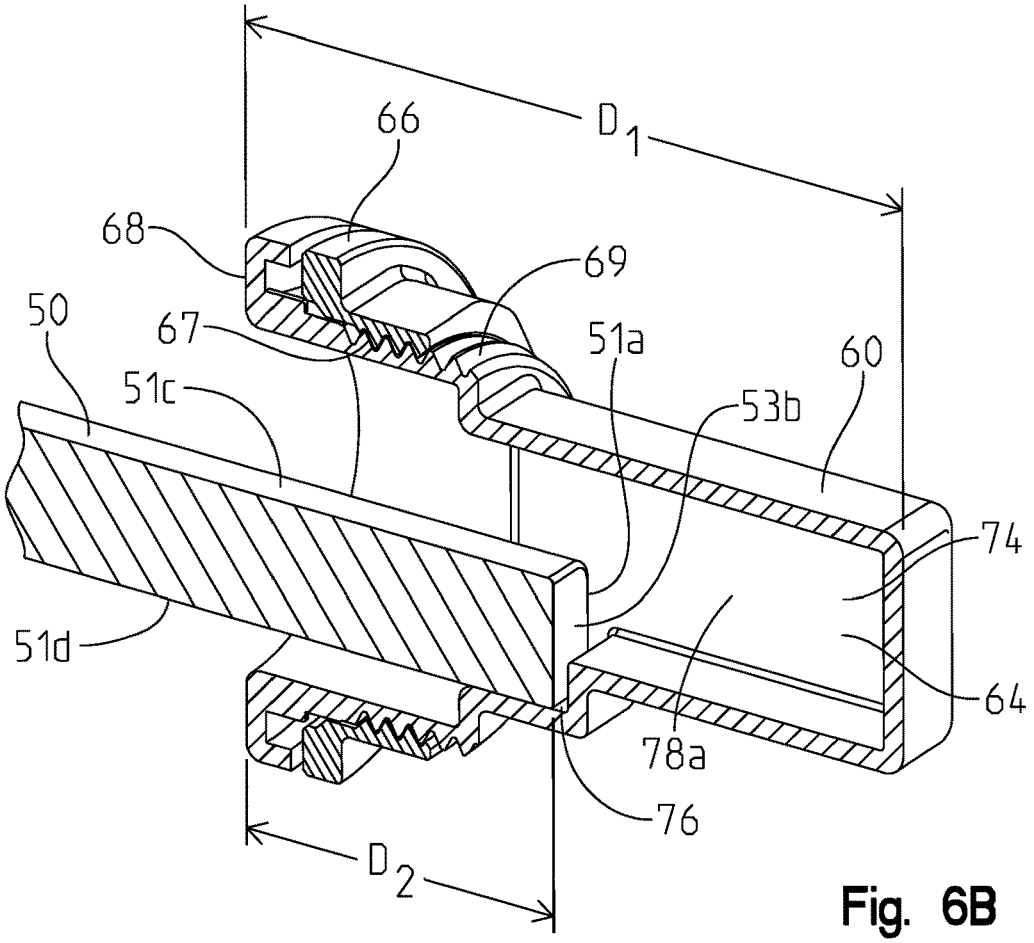
FIG. 6B is a perspective view, in cross-section similar to FIG. 6A, of the accessory bar and the holder of FIG. 1.
Figure 7:
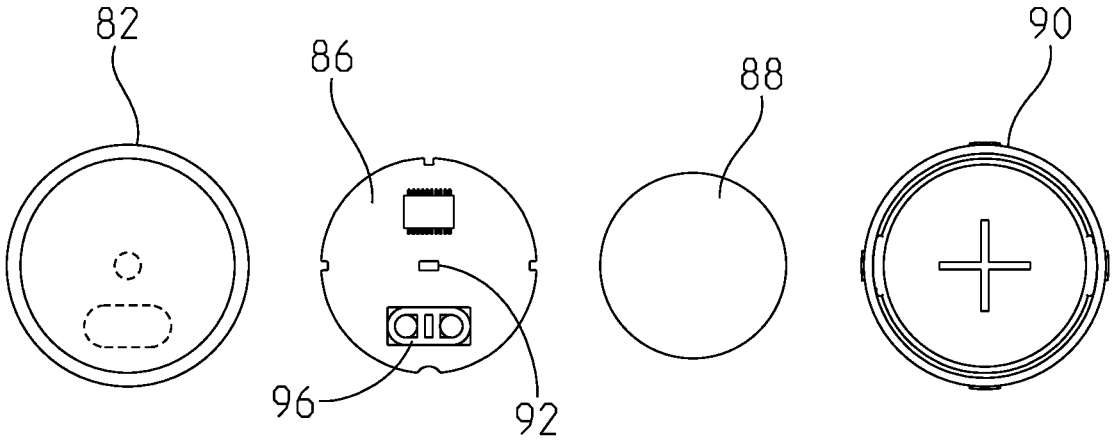
FIG. 7 is a perspective view of various components of the light module of FIG. 4.
Figure 8:
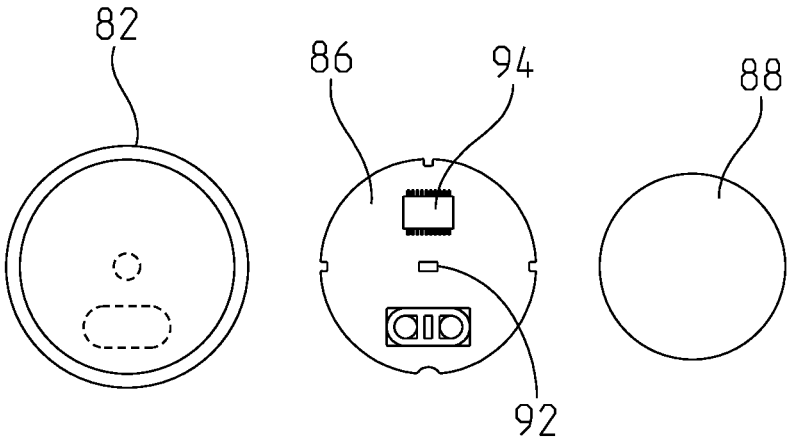
FIG. 8 is a perspective view of the cover, the printed circuit board, and the battery of the light module of FIG. 4.

With reference to FIGS. 1, 3 and 6B, the accessory bar 50 is illustratively secured in place in the openings 40*a*, 41*a* or 40*b*, 41*b* of the sink basin 12 by holders 60. The ends 53*a* and 53*b* of the accessory bar 50 are inserted through the openings 40*b* and 41*b* or 40*a* and 41*a* as further detailed herein. The ends 53*a* and 53*b* of the accessory bar 50 are inserted into a receiver or chamber 64 of each holder 60 (FIG. 3). A nut 66 includes internal threads 67 that are coupled to external threads 69 on each holder 60 to secure the assembly in place. A front flange 68 of the holder 60 takes up slack between the diameter of the openings 40*a*, 40*b*, 41*a*, 41*b* and the diameter of the accessory bar 50, thus securing the accessory bar 50 in place so it does not slide or rotate out of position. Alignment tabs 70 may extend radially outwardly from the holder 60 adjacent to the flange 68 for receipt within recesses or slots 72 in the respective sidewall 20, 22 to facilitate rotational alignment therebetween.

With reference to FIGS. 6A and 6B, the receiver 64 of the holder 60 illustratively includes a first or upper receiving chamber 74, and a second or lower receiving chamber 76. The upper receiving chamber 74 has a first axial depth ($D_1$) and the lower receiving chamber 76 has a second axial depth ($D_2$), wherein the first axial depth ($D_1$) is greater than the second axial depth ($D_2$). The greater second axial depth ($D_2$) facilitates insertion of the opposing ends 53*a*, 53*b* of the accessory bar 50 into the holders 60 when fixed within the openings 40*b* and 41*b* or 40*a* and 41*a* of the respective sidewall 20, 22.

According to an illustrative embodiment, during installation into the opposing holders 60 of the sidewalls 20 and 22, one of the opposing ends 53*b*, 53*a* is inserted into a respective upper receiving chamber 74 of a first holder 60 and slid axially therein so that the other opposing end 53*a*, 53*b* can be inserted into the respective upper receiving chamber 74 of an opposing second holder 60. The accessory bar 50 can then be substantially centered between the opposing holders 60 such that the ends 53*a*, 53*b* can be lowered into the respective lower receiving chambers 76 and axially secured therein. Opposing flat walls 78*a* and 78*b* of the holder 60 cooperate with the flat walls 51*a* and 51*b* of the accessory bar 50 to rotationally secure the accessory bar 50 relative to the holder 60 (FIGS. 2B and 6B).

Alternatively, the accessory bar 50 is removable by removing the nut 66 and holder 60 and sliding the accessory bar 50 out of the openings 40*b* and 41*b* or 40*a* and 41*a*. Once the holders 60 are secured in place, the accessory bar 50 may be removed and inserted. In place of the accessory bar 50, a light assembly or module 80 may in be inserted in the sink basin 12 (FIG. 3).

With reference to FIGS. 4-6A, 7 and 8, the illustrative light module 80 includes a cover 82, a seal 84, a printed circuit board (PCB) 86, a power source 88 and a PCB cover or support 90. The PCB 86 includes a light 92, a controller 94, and a sensor 96. In an illustrative embodiment, the light 92 is a light emitting diode (LED). Illustratively, the power source 88 is conventional, such as a battery. In one illustrative embodiment, the sensor 96 is an infrared motion sensor including a transmitter 98 and a receiver 100. Illustratively, the seal 84 includes a first opening 102 and a second opening 104. When assembled, the transmitter 98 is inserted into the first opening 102 and the receiver 100 is inserted into the second opening 104 so that the seal 84 protects the sensor 96 from moisture when the assembly 80 is inserted into the sink basin 12. The cover 82 is illustratively formed of a polymer and is translucent to allow the transmission of light therethrough (for example, from the light 92 and to the sensor 96).

When inserted in the sink basin 12, the light module 80 is secured in place with similar components and methods to the accessory bar 50. The light module 80 is inserted into the holder 60 which is secured onto the sink basin 12 via nut 66.

The cover 90 illustratively includes biased fingers 106 to facilitate frictional engagement within the receiver 64 of the holder 60. As described above, the front flange 68 of the holder 60 takes up slack between the diameter of the openings 40*a*, 40*b*, 41*a*, 41*b* and the diameter of the light module 80, thus securing the light module 80 in place so it does not slide or rotate out of position. Additionally, the cover 82 protects the other components of the light module 80 from being touched by any matter, such as fluids, that may be in sink basin 12.

Figure 12:
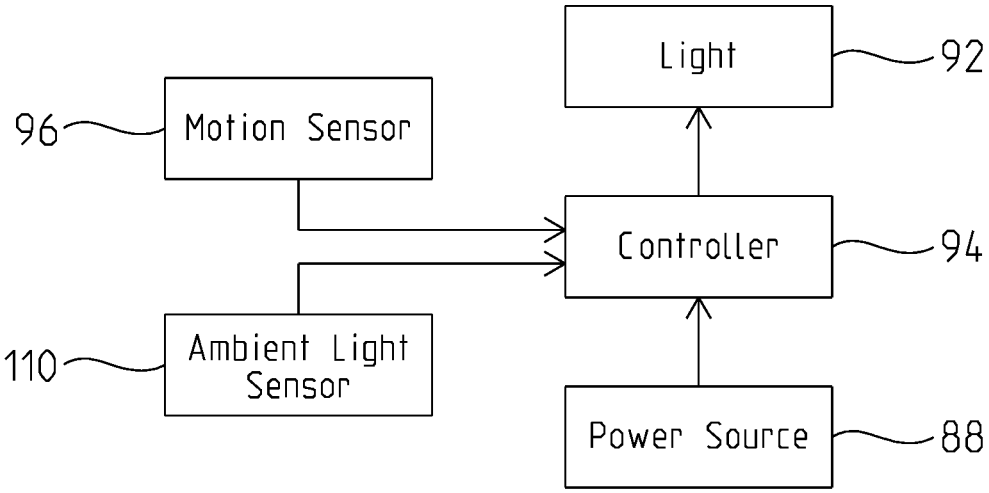
FIG. 12 is a block diagram of the light module of FIG. 4.

With reference to FIG. 12, the power source 88 provides power to the controller 94. Based on inputs, the controller 94 can activate and deactivate the light 92. As described above, in an illustrative embodiment, the input is from an infrared motion sensor 96. As further detailed herein, an ambient light sensor 110 may also be in communication with the controller 94.

Figure 9:
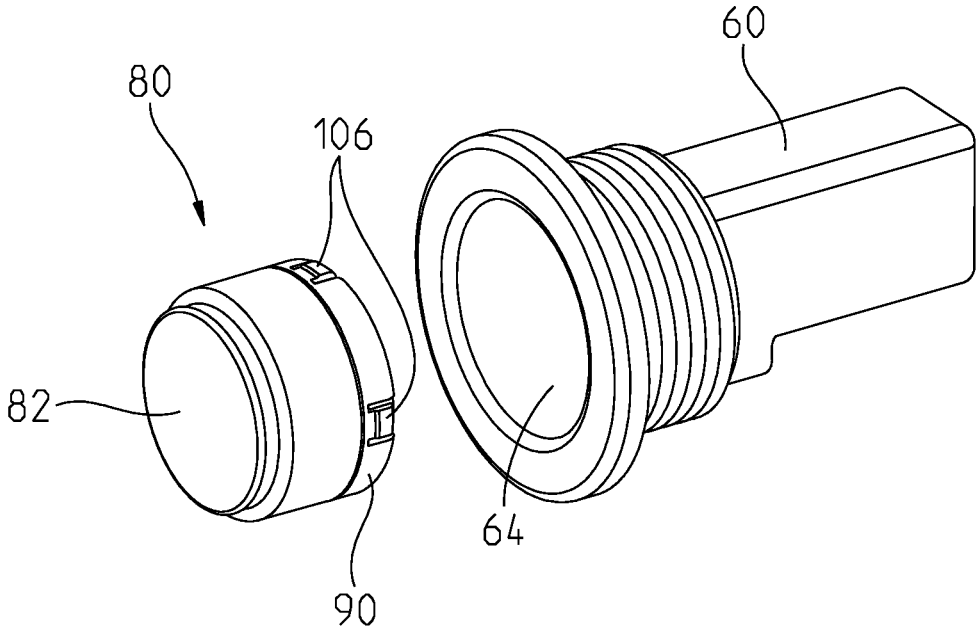
FIG. 9 is a partially exploded perspective view of the light module and the holder of FIG. 4.
Figure 10:
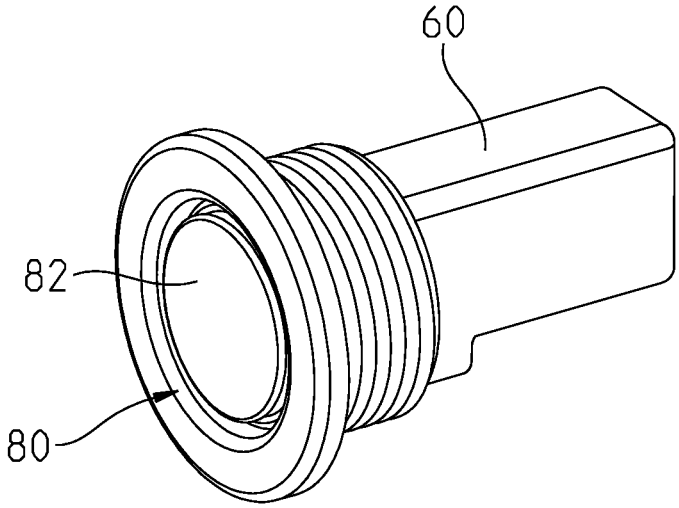
FIG. 10 is a perspective view of the light module and the holder of FIG. 9.
Figure 11:
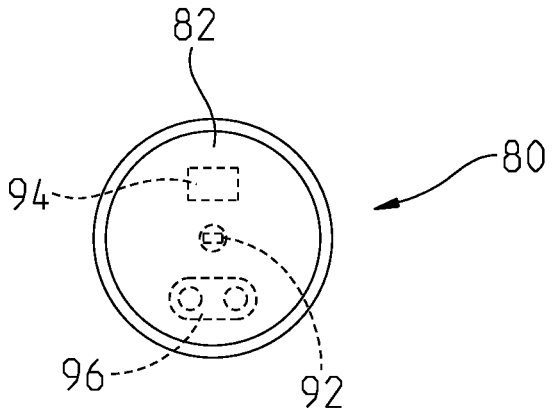
FIG. 11 is an end view of the light module of FIG. 4.
Figure 13:
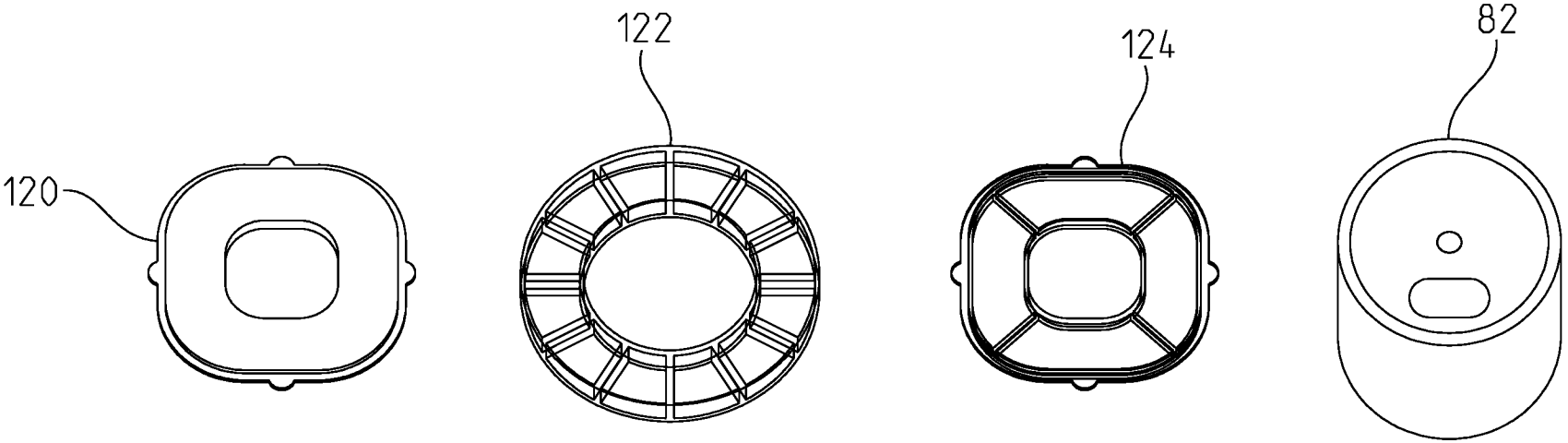
FIG. 13 is a perspective view of various covers for the light module of FIG. 4.

With reference to FIG. 9, cover 82 is illustratively shown as circular and made of a clear material, however, could be any shape that accommodates the light module 80. Other illustrative embodiments of the cover are shown, for example, in FIG. 13, the cover 120 could be square and made from a frosted material, the cover 122 could be circular and made from a frosted material, or the cover 124 could be square and made of a clear material. In one illustrative embodiment, the cover 82, 120, 122, 124 is made of a material, such as a polymer, that can be manufactured by three-dimensional printing.

Figure 14C:
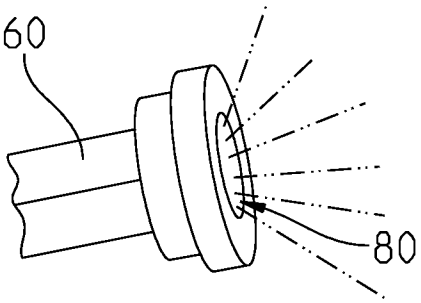
FIGS. 14A-14C are perspective views showing operation of the light module of FIG. 4.
Figure 14B:
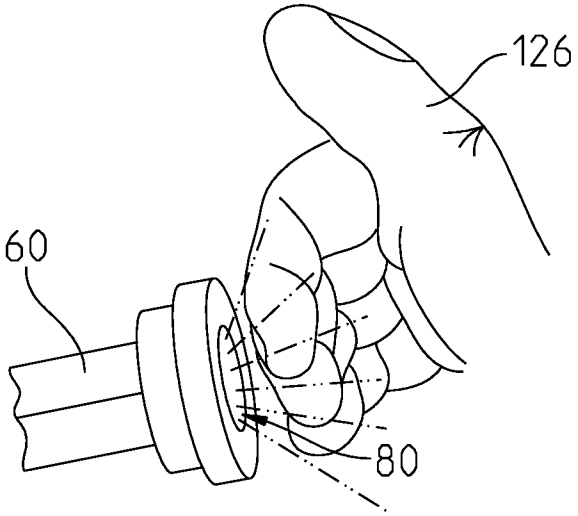
Figure 14A:
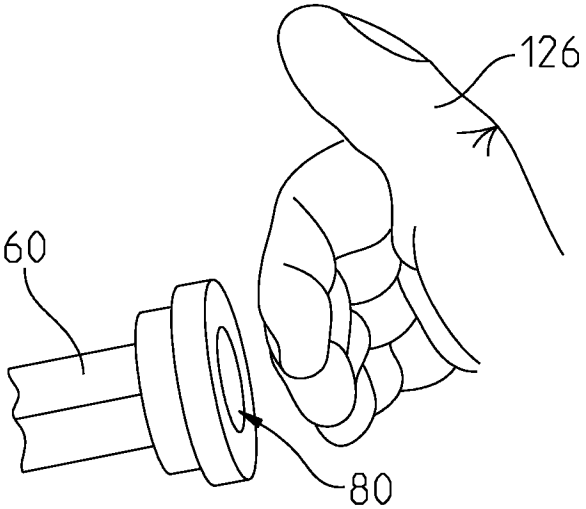

In one illustrative mode of operation, when a user's hand 126 is detected by the sensor 96, the controller 94 will activate the light 92 to illuminate into the sink basin 12 (FIGS. 14A-14C). In one illustrative embodiment, the infrared motion sensor 96 will detect the user's hand 126 when it is a predetermined distance (e.g., 1-2 cm) away from the light module 80. In one illustrative embodiment, the infrared motion sensor 96 will detect the user's hand 126 within 1-2 seconds. In one illustrative embodiment, when the user's hand 126 is removed, the controller 94 deactivates the light 92. Illustratively, the controller 94 waits a specified period of time before deactivating the light 92. In one illustrative embodiment, the controller 94 keeps the light 92 illuminated for ten seconds after the user's hand 126 is removed before deactivating the light 92.

In an illustrative embodiment, the ambient light sensor 110 provides input to the controller 94. In an illustrative mode of operation, the controller 94 does not activate the light 92 if the ambient light sensor 110 detects ambient light in the room where the sink basin 12 is located. In another illustrative mode of operation, the controller 94 only activates light 92 if the light in the room is measured to be below a certain level. FIG. 14A shows the light module 80 in an off or inactive mode. FIG. 14B shows the light module 80 in an on or active mode upon detecting the user's hand 126 in proximity to the sensor 96. FIG. 14C shows the light module 80 in the active mode for a predetermined time after the user's hand 126 is removed.

Although the invention has been described in detail with reference to certain preferred embodiments, variations and modifications exist within the spirit and scope of the invention as described and defined in the following claims.

What is claimed is:

1. A towel bar sink comprising:

a sink basin including:

a front wall, a first side wall, a second side wall and a rear wall extending upwardly from a bottom;

the first side wall having a first opening;

the second side wall having a second opening; and wherein the first opening on the first side wall and the second opening on the second side wall are laterally opposed from each other;

an accessory bar including a first end and a second end;

wherein the first end of the accessory bar is supported by the first opening on the first side wall, and the second end of the accessory bar is supported by the second opening on the second side wall;

a first holder including a first receiver and configured to secure the first end of the accessory bar to the first side wall of the sink basin;

a second holder including a second receiver and configured to secure the second end of the accessory bar to the second side wall of the sink basin;

a light module having a light, a controller operably coupled to the light, and a cover supported proximate the light; and wherein the light module is configured to fit into the first holder or the second holder when the accessory bar is removed from the respective first holder or second holder.

2. The towel bar sink of claim 1, further comprising an accessory supported between the accessory bar and one of the rear wall or the front wall of the sink basin.

3. The towel bar sink of claim 2, wherein the accessory is a storage caddy.

4. The towel bar sink of claim 1, wherein the light module further includes a sensor operably coupled to the controller.

5. The towel bar sink of claim 4, wherein the sensor is an infrared motion sensor and the controller activates the light based on input of a user's hand in the sink basin.

6. A towel bar sink comprising:

a sink basin including a first side wall and a second side wall in laterally spaced relation to the first side wall;

a first holder supported by the first side wall;

a second holder supported by the second side wall; and wherein the first holder and the second holder are configured to alternatively receive opposing ends of an accessory bar, and first and second light modules.

7. The towel bar sink of claim 6, wherein the light module includes a light, a controller operably coupled to the light, and a cover supported proximate the light.

8. The towel bar sink of claim 7, wherein the light module further includes a sensor operably coupled to the controller.

9. The towel bar sink of claim 8, wherein the sensor is an infrared motion sensor and the controller activates the light based on input of a user's hand in the sink basin.

10. The towel bar sink of claim 6, further comprising an accessory supported between the accessory bar and one of a rear wall or a front wall of the sink basin.

11. The towel bar sink of claim 10, wherein the accessory is a storage caddy.

12. A towel bar sink kit comprising:

a sink basin including a first side wall and a second side wall in laterally spaced relation to the first side wall;

a first holder supported by the first side wall;

a second holder supported by the second side wall;

an accessory bar including a first end and a second end;

wherein the first end of the accessory bar is configured to be supported by the first holder;

wherein the second end of the accessory bar is configured to be supported by the second holder;

a first light module configured to fit into the first holder; and a second light module configured to fit into the second holder.

13. The towel bar sink kit of claim 12, wherein:

the first light module includes a light, a controller operably coupled to the light, and a cover supported proximate the light; and the second light module includes a light, a controller operably coupled to the light, and a cover supported proximate the light.

14. The towel bar sink kit of claim 13, wherein at least one of the first light module or the second light module further includes a sensor operably coupled to the controller.

15. The towel bar sink kit of claim 14, wherein the sensor is an infrared motion sensor.

16. The towel bar sink kit of claim 12, further comprising an accessory configured to be supported between the accessory bar, and one of a rear wall or a front wall of the sink basin.

17. The towel bar sink kit of claim 16, wherein the accessory is a storage caddy.

* * * * *